US006394682B1

(12) United States Patent
Zhadanov et al.

(10) Patent No.: US 6,394,682 B1
(45) Date of Patent: May 28, 2002

(54) LIQUID SUPPLY DEVICE, AND CLEANING APPARATUS PROVIDED THEREWITH

(76) Inventors: Sam Zhadanov, 2944 W. 5th St. Apt 20J., Brooklyn, NY (US) 11224; Eli Zhadanov, 2944 W. 5th St., Brooklyn, NY (US) 11214

( * ) Notice: Subject to any disclaimer, the term of this patent is extended or adjusted under 35 U.S.C. 154(b) by 0 days.

(21) Appl. No.: 09/552,020

(22) Filed: Apr. 19, 2000

(51) Int. Cl.[7] ..... A46B 11/06

(52) U.S. Cl. ..... 401/289; 401/282; 239/587.1; 239/587.5

(58) Field of Search ..... 401/289, 282; 4/596, 597, 605, 615; 239/461, 436, 587.1, 587.5

(56) References Cited

U.S. PATENT DOCUMENTS 4,673,307 A * 6/1987 Prestele et al. ..... 401/289
4,720,883 A * 1/1988 Sanchez ..... 401/289
5,235,717 A * 8/1993 Lanzo, Jr. et al. ..... 401/289

* cited by examiner

*Primary Examiner*—David J. Walczak
(74) *Attorney, Agent, or Firm*—I. Zborovsky

(57) ABSTRACT

A liquid supply device, has a first part provided with an inlet for receiving a liquid and passing the liquid there through, a second part for passing the liquid received from the one part and provided with an outlet for issuing the liquid, and a connector for connecting the part with one another so that the outlet can assume a plurality of different angular positions relative to the inlet, the connector being formed so that a user can turn one of the parts relative to the other of the parts to change an angular position of the outlet relative to the inlet, and when a desired position is achieved, a sink of liquid through the parts provides a fixation of the position under the action of a liquid pressure.

9 Claims, 2 Drawing Sheets

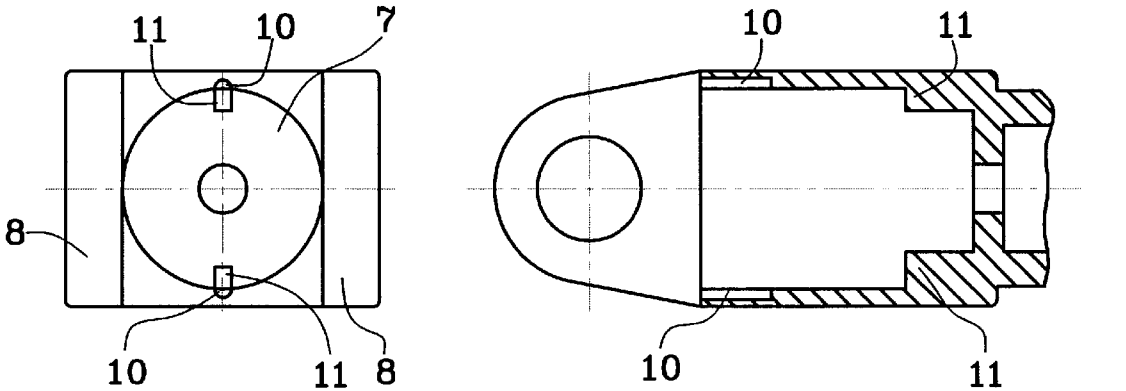
FIG. 3
FIG. 4
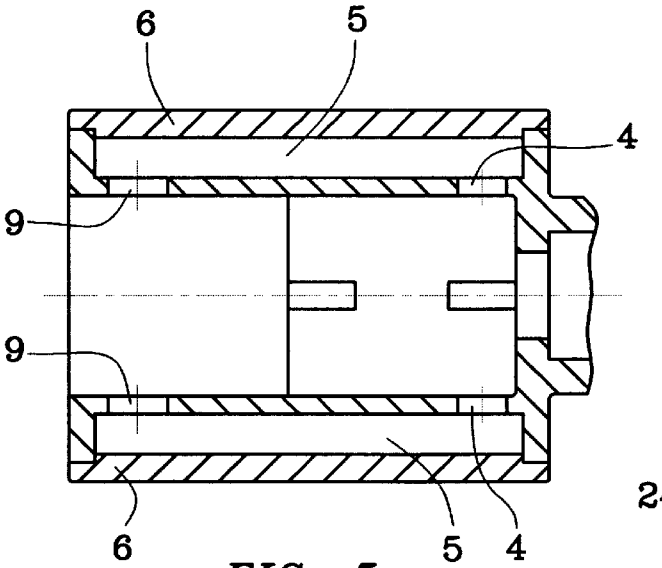
FIG. 5
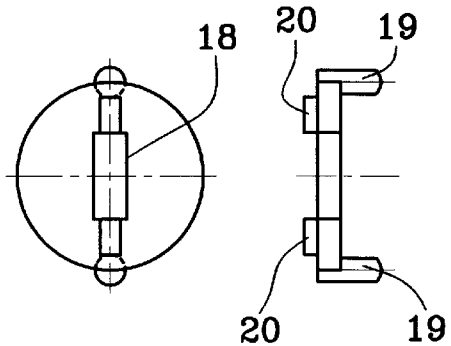
FIG. 6
FIG. 7
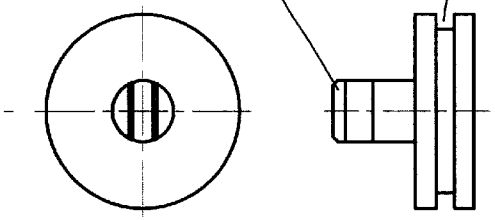
FIG. 8
FIG. 9
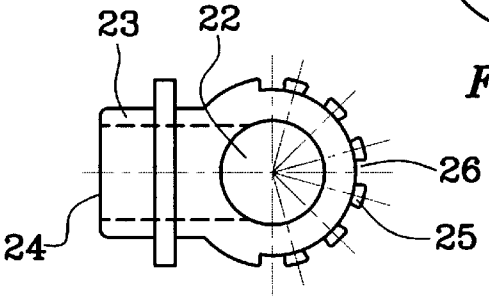
FIG. 10

LIQUID SUPPLY DEVICE, AND CLEANING APPARATUS PROVIDED THEREWITH

BACKGROUND OF THE INVENTION

The present invention relates to a liquid supply device, in particular to devices for supplying water, and to a cleaning apparatus provided therewith.

Devices for supplying water are known in the art. Such devices are for example connected to a source of water which can be represented by a water main, and have an inlet connected to the water source and an outlet for issuing water from the device. Some devices of this type are provided with means for turning arranged so that the issuing outlet can be boated at different angles with respect to an inlet of the device. It is desirable to further improve the devices of the above mentioned type, which will be characterized by a reliable hermatilization, a wide range of turning for example by 180°, and automatic fixation of a working position of the device.

SUMMARY OF THE INVENTION

Accordingly, it is an object of the present invention to provide a liquid supply device for the above mentioned general type which is a further improvement of the existing devices.

In keeping with these objects and with others which will become apparent hereinafter, one feature of present invention resides, briefly stated in a liquid supply device which has a first part provided with an inlet for receiving a liquid and passing the liquid there through, a second part for passing the liquid received from the one part and provided with an outlet for issuing the liquid, and means for connecting the part with one another so that the outlet can assume a plurality of different angular positions relative to the inlet, the connecting means being formed so that a user can turn one of the parts relative to the other of the parts to change an angular position of the outlet relative to the inlet, and when a desired position is achieved, a sink of liquid through the parts provides a fixation of the position under the action of a liquid pressure.

It is also another feature of the present invention to provide a cleaning apparatus provided with this device.

The novel features which are considered as characteristic for the present invention are set forth in particular in the appended claims. The invention itself however, both as to its construction and its method of operation, together with additional objects and advantages thereof, will be best understood from the following description of specific embodiments when read in connection with the accompanying drawings.

BRIEF DESCRIPTION Of THE DRAWINGS

FIGS. 3, 4, and 5 are an end view, a side view and a top view of a housing of the inventive device, in a section;

FIGS. 6 and 7 are views showing an end view and a side view of a ring shaped element of the inventive device;

FIGS. 8 and 9 are an end view and a side view of a piston of the inventive device; and FIG. 10 shows a T-shaped fitting of the inventive device.

DESCRIPTION OF PREFERRED EMBODIMENTS

Figure 1:
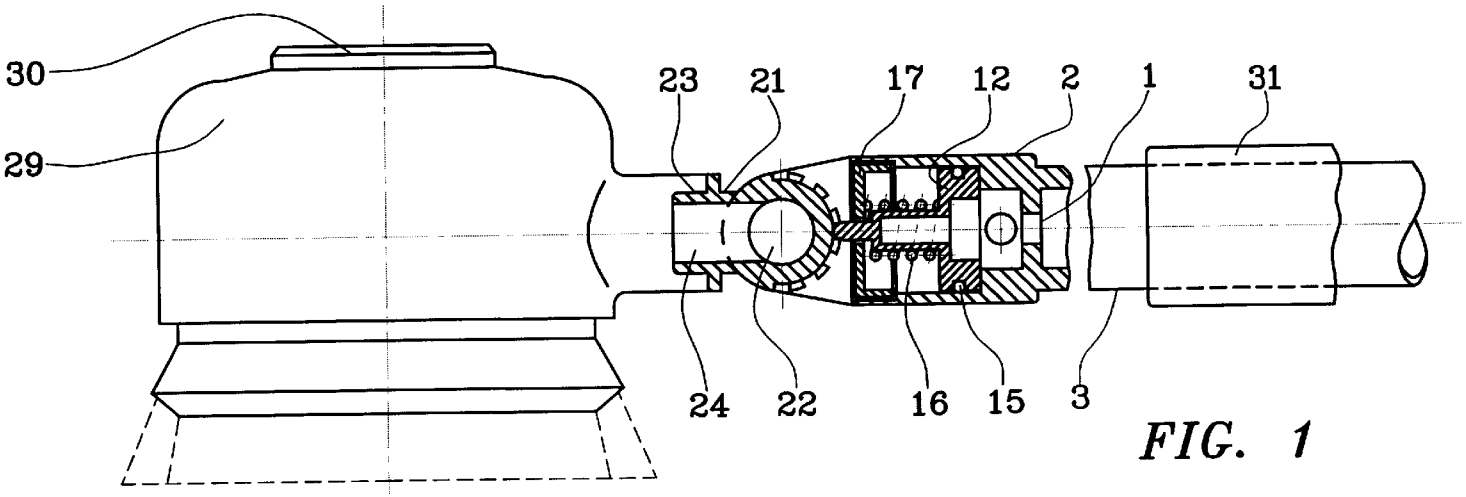
FIGS. 1 and 2 area side view and a plan view partially sectioned of a liquid supply device and an apparatus provided therewith, in accordance with the present invention.
Figure 2:
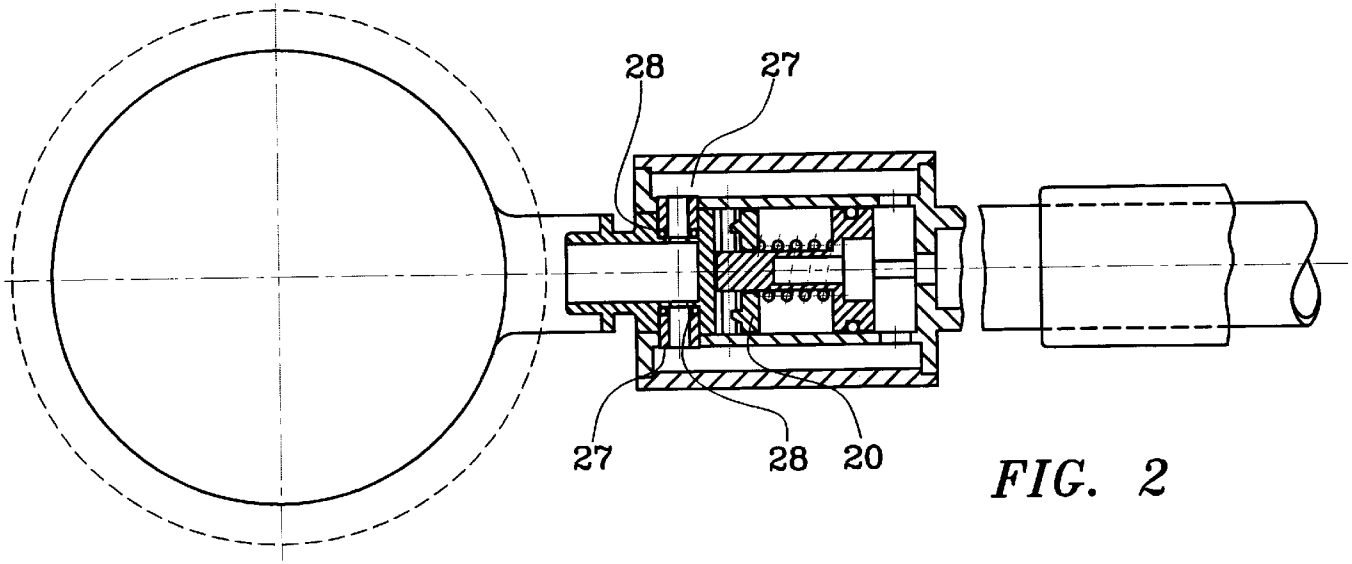

A liquid supplying device in accordance with the present invention has a liquid inlet formed as an opening 1 which is shown in FIG. 1 and provided in a housing 2 connectable to a water line by a pipe 3. A telescopable extusion 31 or another telescopable liquid supplying element can be connected with the pipe 3. The housing 2 as specifically shown in FIGS. 4 and 5 has two side openings 4 which communicate with cavities 5. The cavities 5 are closed by covers 6. The housing is further provided with a cylindrical opening 7 located in its center and two side walls 8 with openings 9. The cylindrical opening of the housing is provided with lateral slots 10 in an upper part and lateral projections 11 in a lower part.

A piston 12 shown in FIGS. 8 and 9 is inserted in the opening of the housing. An end of a piston rod of the piston is formed as a conical tooth having a rectangular cross-section and forming tooth means. The piston has a groove 14 which accommodates a sealing ring 15 shown in FIG. 1. A compression spring 16 is arranged on the piston rod.

A ring 17 shown in FIGS. 1, 6 and 7 supports the piston 12 and is located in an upper part of the cylindrical opening of the housing. It has a rectangular opening 18 with two side columns 19 and two projections 20 which are parallel to the axis of the opening 18.

A T-shaped fitting element 21 shown in FIGS. 1 and 10 is arranged between the side walls of the housing. It has a side opening 22, a pipe 23 with an opening 24. An outer surface of the T-shaped fitting is a toothed portion 25 with conical grooves 26, which forms toothed means. A connection of the housing 2 with the T-shaped fitting 21 is performed by hollow bushings 27, and its sealing is performed by rubber O-rings 28. The hollow bushings 27 on the one hand form an axle of turning of the fitting element 21, and on the other hand form passages for water. A pipe 23 of the fitting forms a liquid outlet and also is used for connecting the fitting to a water issuing element, for example a rotary cleaner 29 and the like, provided with an inlet 30 for supplying of washing substances (soap etc.) The cleaning device can include a rotatable head with a cleaning element (brush) attached to it. In an open position of the liquid supplying device, water flows from a pipe 3 from an opening 1 in the housing 2, and then through the side openings 4 and cavities 5 of the housing into the interior of the hollow bushings 27 into the opening 24 of the fitting element 21, to and through the rotary cleaner 29.

The housing 2 with the piston 12 and the ring 17 form a first part of the liquid supplying device while the feeding element 21 forms a second part of the liquid supplying device.

A user sets the water issuing element, for example the water issuing device in a desired position by turning of the pipe 23. The toothed projections 20 during turning of the pipe 23 move on the grooves 26 of the toothed segment 25 because the spring 16 can be compressed and relaxed. A vertical movement of the ring 17 is provided by the guiding columns 19 and the grooves 10, Then the user turns on a liquid supply, in this case a water supply, by a faucet or another similar element, Resistance to issuance of a liquid through the outlet generates a pressure in the system which acts on the piston 12, compresses the spring 16, displaces the piston rod of the piston to the extreme upper position, a portion 13 of the piston rod is introduced into the groove 26 of the toothed sector and locks the thusly set position. When water stops to flow from the inlet to the outlet, the pressure in me system drops to zero, the spring 16 returns the piston rod to its initial position, to abutment against the projections 11.

It will be understood that each of the elements described above, or two or more together, may also find a useful application in other types of constructions differing from the types described above.

While the invention has been illustrated and described as embodied in a liquid supply device, it is not intended to be limited to the details shown, sincevarious modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A liquid supply device, comprising a first part provided with an inlet for receiving a liquid and passing the liquid there through; a second part for passing the liquid received from said one part and provided with an outlet for issuing the liquid; and means for connecting said part with one another so that said outlet can assume a plurality of different angular positions relative to said inlet, said connecting means being formed so that a user can turn one of said parts relative to the other of said parts to change an angular position of said outlet relative to said inlet, and when a desired position is achieved, a liquid flowing through said parts provides a fixation of said position under the action of a liquid pressure.

2. A liquid supply device as defined in claim 1; and further comprising spring means arranged so that when the user turns one of said parts relative to the other of said parts said spring compresses to allow the turning, and when said fixed position is obtained said spring means is relaxed to fix said position.

3. A liquid supply device as defined in claim 1; and further comprising first toothed means provided on said first part and second tooth means provided on said second part, said first and second tooth means being in engagement with one another, such that during turning by the user one of said parts relative to the other of said parts said first and second toothed means move over one another, and when said position is fixed said tooth means are retained immovably relative to one another.

4. A liquid supply device as defined in claim 3, wherein one of said tooth means is formed as a single tooth provided on one of said parts, while the other of said toothed means is formed as a tooth sector with a plurality of teeth.

5. A liquid supply device as defined in claim 1; and further comprising two hollow bushings which form an axle for turning of said second part and also form passages for water.

6. A cleaning apparatus comprising a cleaning device; and a liquid supply device for supplying water to said cleaning device, said liquid supply device including a first part provided with an inlet for receiving a liquid and passing the liquid there through; a second part for passing the liquid received from said one part and provided with an outlet for issuing the liquid; and means for connecting said part with one another so that said outlet can assume a plurality of different angular positions relative to said inlet, said connecting means being formed so that a user can turn one of said parts relative to the other of said parts to change an angular position of said outlet relative to said inlet, and when a desired position is achieved, a liquid flowing through said parts provides a fixation of said position under the action of a liquid pressure.

7. A cleaning apparatus as defined in claim 6, wherein said cleaning device has a rotatable head and a cleaning element attached to it.

8. An cleaning apparatus as defined in claim 6, wherein said cleaning device has a cleaning substance supply system.

9. An cleaning apparatus as defined in claim 6; and further comprising a telescopable liquid supplying element connected with said inlet of said first part.

* * * * *